US009068238B2

(12) United States Patent
Ariga et al.

(10) Patent No.: US 9,068,238 B2
(45) Date of Patent: Jun. 30, 2015

(54) HIGH TENSILE STRENGTH HOT ROLLED STEEL SHEET HAVING EXCELLENT FORMABILITY AND METHOD FOR MANUFACTURING THE SAME

(75) Inventors: Tamako Ariga, Tokyo (JP); Katsumi Nakajima, Tokyo (JP); Tetsuya Mega, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 381 days.

(21) Appl. No.: 13/638,157

(22) PCT Filed: Mar. 30, 2011

(86) PCT No.: PCT/JP2011/001931

§ 371 (c)(1),
(2), (4) Date: Nov. 30, 2012

(87) PCT Pub. No.: WO2011/122031

PCT Pub. Date: Oct. 6, 2011

(65) Prior Publication Data

US 2013/0133790 A1 May 30, 2013

(30) Foreign Application Priority Data

Mar. 31, 2010 (JP) ..... 2010-082425

(51) Int. Cl.

| | |
|---|---|
| ***C22C 38/14*** | (2006.01) |
| ***C22C 38/12*** | (2006.01) |
| ***C21D 8/02*** | (2006.01) |
| ***C21D 8/04*** | (2006.01) |
| ***C21D 9/48*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/28*** | (2006.01) |
| ***C22C 38/38*** | (2006.01) |

(52) U.S. Cl.

CPC ..... *C21D 8/0226* (2013.01); *C21D 8/0426* (2013.01); *C21D 8/0463* (2013.01); *C21D 9/48* (2013.01); *C21D 2211/004* (2013.01); *C21D 2211/005* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/24* (2013.01); *C22C 38/28* (2013.01); *C22C 38/38* (2013.01)

(58) Field of Classification Search

None

See application file for complete search history.

(56) References Cited

U.S. PATENT DOCUMENTS

| | | | | |
|---|---|---|---|---|
| 2008/0060728 | A1 | 3/2008 | Kohno et al. | |
| 2009/0095381 | A1 | 4/2009 | Ariga et al. | |
| 2010/0196189 | A1 * | 8/2010 | Nakagawa et al. | 420/114 |

FOREIGN PATENT DOCUMENTS

| | | |
|---|---|---|
| CN | 1520464 | 8/2004 |
| JP | 2004-143518 | 5/2004 |
| JP | 3591502 | 11/2004 |
| JP | 2005-002406 | 1/2005 |
| JP | 2005-307339 | 11/2005 |
| JP | 2006-161112 | 6/2006 |
| JP | 3821036 | 9/2006 |
| JP | 2007-063668 | 3/2007 |
| JP | 2007-262487 | 10/2007 |
| JP | 2009-052139 | 3/2009 |
| JP | 2009-084643 | 4/2009 |
| KR | 2010-0029138 | 3/2010 |

OTHER PUBLICATIONS

Machine-English translation of Japanese Patent No. 2006-161112, entitled "High Strength Hot rolled Steel Sheet and Its production," Imai Norio et al., Jun. 22, 2006.*

Chinese Official Action—201180026093.X—Jan. 27, 2014.

Office Action dated Apr. 29, 2013 issued by the Taiwan Patent Office in corresponding Taiwanese Patent Application No. 100111285, 3 pages.

International Search Report PCT/JP2011/001931 dated Jun. 28, 2011, with English translation.

Korean Office Action dated Aug. 11, 2014 in corresponding Korean Patent Application No. 2012-7028087 with English translation of Korean Office Action.

Korean Official Action—2012-7028087—Aug. 27, 2013 (partial English translation).

Korean Official Action—2012-7028087—Jan. 2, 2014.

KR Office Action dated Mar. 4, 2013, with English translation; Application No. 2012-7028087.

* cited by examiner

*Primary Examiner* — Deborah Yee

(74) *Attorney, Agent, or Firm* — Young & Thompson

(57) ABSTRACT

Described is a high tensile strength hot rolled steel sheet having high strength and formability, and a manufacturing method. It has tensile strength ≥980 MPa and excellent formability, and specifically identified ranges by mass % of C, Si, Mn, P, S, N, Al, Ti, V, Solute V, and Solute Ti; (ii) microstructure with fine carbides dispersion precipitated therein, the fine carbides containing Ti and V and having the average particle diameter <10 nm, as well as volume ratio with respect to the entire microstructure ≥0.007; and matrix as ferrite phase having area ratio with respect to the entire microstructure ≥97%. C, Ti, V, S and N satisfy (1) Ti≥0.08 +(N/14×48+S/32×48) and (2) 0.8≤(Ti/48+V/51)/(C/12)≤1.2, where "C", "Ti", "V", "S" and "N" represent contents (mass %) of corresponding elements, respectively.

16 Claims, No Drawings

HIGH TENSILE STRENGTH HOT ROLLED STEEL SHEET HAVING EXCELLENT FORMABILITY AND METHOD FOR MANUFACTURING THE SAME

TECHNICAL FIELD

The present invention relates to a high tensile strength hot rolled steel sheet having tensile strength (TS) of at least 980 MPa and excellent formability, which is suitable for a material of automobile parts and the like. The present invention also relates to a method for manufacturing the high tensile strength hot rolled steel sheet.

PRIOR ART

There has been a demand in recent years from the viewpoint of global environment for reducing body weight of automobiles to improve fuel efficiency thereof in order to decrease $CO_2$ emission. Further, there has been a demand for increasing strength of an automobile vehicle body and improving collision safety thereof to ensure safety of occupants during a collision. It is effective, in terms of simultaneously satisfying both reduction of automobile body weight and improvement of safety, to increase strength of a material of automobile parts and reduce sheet thickness and thus weight thereof to the extent that rigidity of the parts should not cause a problem. In view of this, a high tensile strength steel sheet has been actively used for automobile parts in recent years. There has been a trend in the automobile industry toward employing a high tensile strength hot rolled steel sheet having tensile strength (TS) of 780 MPa class as a material for a chassis member. Further increase in strength of steel sheets for automobiles is pursued recently and application of a steel sheet having tensile strength of at least 780 MPa class, possibly at least 980 MPa class, is being actively studied.

On the other hand, most of automobile parts using a steel sheet as a material thereof are subjected to forming, e.g. press-forming, burring process and the like, whereby a steel sheet for use in automobile parts is required to have excellent formability. A hot rolled steel sheet as a material of a chassis member in particular needs to be a high tensile strength hot rolled steel sheet excellent not only in strength but also in formability such as elongation, stretch-flange ability and the like because a chassis member generally has a complicated shape. A hot rolled steel sheet as a material of a skeleton member of an automobile body is further required to have excellent bending properties regarding formability thereof.

However, formability of a steel material generally deteriorates as strength thereof increases and thus a high tensile strength hot rolled steel sheet generally exhibits much poorer formability than a standard soft steel sheet. Accordingly, it is necessary to develop a high tensile strength hot rolled steel sheet having good strength and good formability in a compatible manner in order to apply a high tensile strength hot rolled steel sheet to a chassis member and the like. There have been made various studies up to now in this regard.

For example, JP-B 3591502 proposes as a technique of increasing strength of a steel sheet, while ensuring good formability thereof, a technique regarding a high tensile strength steel sheet having tensile strength of ≥590 MPa and excellent formability, characterized in that: microstructure of the steel sheet is substantially constituted of ferrite single phase; and carbides including Ti and Mo having the average particle diameter of 10 nm or less are dispersion-precipitated therein. The technique of JP-B 3591502, however, has a problem of significantly high production cost due to use of expensive molybdenum.

JP-A 2006-161112 proposes a high-strength hot rolled steel sheet having ≥880 MPa tensile strength, ≥0.80 yield ratio, a microstructure which contains ≥70 vol. % of ferrite having ≤5 μm average grain size and ≥250 Hv hardness, and a composition consisting of, by mass, 0.08 to 0.20% C, 0.001 to <0.2% Si, >1.0 to 3.0% Mn, 0.001 to 0.5% Al, >0.1 to 0.5% V, 0.05 to <0.20% Ti, 0.005 to 0.05% Nb and the balance Fe with impurities and satisfying inequality (1) $(Ti/48+Nb/93)\times C/12\leq 4.5\times 10^{-5}$, inequality (2) $0.5\leq(V/51+Ti/48+Nb/93)/(C/12)\leq 1.5$ and inequality (3) $V+Ti\times 2+Nb\times 1.4+C\times 2+Mn\times 0.1\geq 0.80$, wherein the atomic symbols represent the respective contents (unit: mass %) of the elements.

However, the technique proposed by JP-A 2006-161112 fails to study stretch-flange ability and causes a problem in that sufficient stretch-flange ability cannot be always obtained when ≥780 MPa tensile strength is pursued. JP-B 3821036 proposes a technique regarding a hot rolled steel sheet, characterized in that: the hot roiled steel sheet has a composition containing by mass %, 0.0002 to 0.25% C, 0.003 to 3.0% Si, 0.003 to 3.0%. Mn and 0.002 to 2.0%. Al, and balance as Fe and incidental impurities, wherein P, S and N contents in the incidental impurities are 0.15% or less, 0.05% or less and 0.01% or less, respectively; at least 70%, by area ratio, of metal microstructure is ferrite phase; the average crystal grain size of a ferrite phase is ≤20 μm; the aspect ratio of the ferrite phase is ≤3; ≥70% of the ferrite grain boundaries consist of large-angled grain boundaries; the area ratio of precipitates each having the maximum diameter of ≤30 nm and the minimum diameter of ≥5 nm in the ferrite phase formed at the large-angled grain boundaries is ≤2% of the microstructure; the average crystal grain size of the second phase having the largest area ratio among the balance phase other than the ferrite phase and the precipitates is ≤20 μm; and the large-angled grain boundaries of the ferrite phase are present between the nearest second phases. Further, JP-B 3821036 discloses obtaining ferrite single phase microstructure as microstructure of the steel sheet by reducing carbon content to a very low level and also reducing content of Mn as an austenite-stabilizing element.

However, when carbon content is reduced to a very low level, content of precipitated carbide such as TiC and NbC, which are effective in terms of precipitation strengthening, decreases, whereby ≥780 MPa tensile strength cannot be achieved in a case where a steel sheet with ferrite single phase microstructure having good formability is pursued. Accordingly, there arises in the technique proposed by JP-B 3821036 a problem in that a steel sheet having tensile strength of at least 780 MPa and substantially constituted of ferrite single phase microstructure to ensure good formability such as good elongation and stretch-flange ability cannot be manufactured.

Further, JP-A 2009-052139 proposes a technique regarding a high-strength steel sheet excellent in stretch-flange ability after forming and corrosion resistance after coating, comprising: a composition containing by mass %, C: 0.02 to 0.20%, Si: 0.3% or below, Mn: 0.5 to 2.5%, P: 0.06% or below, S: 0.01% or below, 0.1% or below, Ti: 0.05 to 0.25%, and V: 0.05 to 0.25% with the balance consisting of Fe and incidental impurities; and microstructure substantially constituted of ferrite single-phase, wherein contents of Ti, V, and solute V in precipitates of less than 20 nm in size in the ferrite single phase microstructure are 200 to 1,750 mass ppm, 150 to 1,750 mass ppm, and 200 to less than 1,750 mass ppm, respectively.

The technique described in JP-A 2009-052139 attempts to increase strength of a steel sheet by making precipitates contained in the steel sheet minute (less than 20 nm in size). Further, the technique described in JP-A 2009-052139 attempts to improve stretch-flange ability after forming process by using Ti—V containing precipitates as precipitates which can remain minute in a steel sheet and setting content of solute V contained in the steel sheet to be a desired range. JP-A 2009-052139 states that a high strength hot rolled steel sheet having tensile strength of at least 780 MPa and excellent in stretch-flange ability after forming and corrosion resistance after coating can be obtained according to the technique thereof.

DISCLOSURE OF THE INVENTION

Problems to be Solved by the Invention

JP-A 2009-052139 states that a hot rolled steel sheet having strength of 780 MPa class and excellent formability (elongation and stretch-flange ability) can be manufactured by the technique it proposes. However, the technique described in JP-A 2009-052139 specifies precipitate size to be <20 nm and simply setting precipitate size to be "less than 20 nm or so" results in unstable precipitation strengthening capacity because fine precipitates each having particle diameter of less than 10 nm or so actually plays the main role in precipitation strengthening as revealed in JP-B 3591502. The technique proposed by JP-A 2009-052139 therefore causes a problem that it is difficult to reliably ensure strength equal to or higher than 980 MPa with maintaining excellent formability. Further, there arises another problem in JP-A 2009-052139 that attempt to obtain strength of at least 980 MPa in particular tends to make uniformity of steel sheet properties insufficient and cause variation in the properties (e.g. strength) in the steel sheet widthwise direction in particular, thereby making it impossible to attain satisfactory properties at end portions in the widthwise direction of a steel sheet.

In other words, the technique proposed by JP-A 2009-052139 causes a problem in that it is difficult to stably and reliably supply hot rolled steel sheets each having strength of at least 980 MPa when mass production of such hot rolled steel sheets on an industrial scale is essential in order to stably supply the steel sheets as a material of automobile parts to be mass-produced. Yet further, there arises another problem in JP-A 2009-052139 that production yield deteriorates due to possible failure in obtaining satisfactory properties at end portions in the widthwise direction of a steel sheet.

The present invention aims at advantageously solving the prior art problems described above and an object thereof is to provide a high tensile strength hot rolled steel sheet suitable for use in automobile parts and a manufacturing method thereof, which high tensile strength hot rolled steel sheet has tensile strength (TS) of at least 980 MPa and excellent formability (elongation, strength-flange ability and optionally bending properties) which makes the steel sheet applicable to both a material of a chassis member or the like to be press-formed to have complicated sectional configurations and a material of a skeleton member of an automobile.

Means for Solving the Problem

In order to solve the aforementioned problems, the inventors of the present invention keenly studied: increase in strength and improvement of formability (elongation, stretch-flange ability and optionally bending properties) of a hot rolled steel sheet; and various factors affecting productivity in industrial mass production of a hot rolled steel sheet, and made the following discoveries.

1) Constituting microstructure of a steel sheet predominantly of ferrite single phase having relatively low dislocation density and excellent formability and achieving precipitation strengthening through dispersion-precipitation of fine carbides significantly increase strength of a hot rolled steel sheet without deteriorating elongation thereof so much.
2) Fine carbides having the average particle diameter of less than 10 nm, which carbides are effective for precipitation strengthening, must be dispersion-precipitated at a desired volume ratio in order to obtain a hot rolled steel sheet having excellent formability and high strength or tensile strength (TS) of at least 980 MPa.
3) Ti—V based carbide is effective as fine carbide contributing to precipitation strengthening, in view of reliably obtaining high strength.
4) It is necessary to ensure sufficient content of titanium, which forms Ti carbide as precipitation nucleus, in order to dispersion-precipitate Ti—V based fined carbides having the average particle diameter of less than 10 nm at a desired volume ratio. Specifically, it is necessary to control a composition of steel as a material such that Ti content is equal to or higher than a predetermined content determined according to contents of N and S in the steel (i.e. $Ti \geq 0.08 + (N/14 \times 48 + S/32 \times 48)$. Further, it is necessary that contents of C, Ti and V in the steel as a material satisfy a predetermined relationship $(0.8 \leq (Ti/48 + V/51)/(C/12) \leq 1.2)$ in order to achieve stable precipitation of Ti—V based fine carbides.
5) Presence of solute vanadium by a content in the predetermined range in a hot rolled steel sheet significantly improves stretch-flange ability.
6) Presence of too much solute titanium by a content equal to or higher than the upper limit in a hot rolled steel sheet results in failure in attaining targeted strength.
7) It is important to controllably setting coiling temperature during coiling of a hot rolled steel sheet to be a desired temperature range in order to constitute matrix of microstructure of a hot rolled steel sheet substantially of ferrite single phase and make Ti—V based fine carbides having the average particle size of less than 10 nm be dispersion-precipitated at a desired volume ratio.
8) Deterioration of properties of a hot rolled steel sheet in the widthwise direction thereof, observed in the prior art, is caused by excessive cooling of the end portions in the sheet widthwise direction in cooling after hot rolling and resulting insufficient dispersion precipitation of Ti—V based fine carbides.
9) It is possible to obtain a desired dispersion-precipitation state of Ti—V based fine carbides at end portions in the widthwise direction of a hot roiled steel sheet and thus satisfactory properties at end portions in the widthwise direction of the hot rolled steel sheet by: controlling a composition of steel as a material of the hot rolled steel sheet such that Ti content is equal to or higher than a predetermined content determined according to contents of N and S in the steel (i.e. $Ti \geq 0.08 + (N/14 \times 48 + S/32 \times 48)$ and that contents of C, Ti and V in the steel satisfy a predetermined relationship $(0.8 \leq (Ti/48 + V/51)/(C/12) \leq 1.2)$; and controllably setting coiling temperature during coiling of a hot rolled steel sheet to be a desired temperature range.
10) Bending properties improve by setting the total content of solute Ti and solute V in steel to be equal to or higher than a predetermined content, in addition to carrying out the aforementioned settings or adjustments. In this regard, the total content of solute Ti and solute V in steel can be increased to be equal to or higher than the predetermined content by controlling the cooling rate after finish rolling in hot rolling.

The present invention has been contrived based on the aforementioned discoveries and primary features thereof are as follows.

(1) A high tensile strength hot rolled steel sheet having tensile strength of at least 980 MPa and excellent formability, comprising: a composition including by mass %, C: 0.07% to 0.13% (inclusive of 0.07% and 0.13%), Si: 0.3% or less, Mn: 0.5% to 2.0% (inclusive of 0.5% and 2.0%), P: 0.025% or less, S: 0.005% or less, N: 0.0060% or less, Al: 0.06% or less, Ti: 0.08% to 0.14% (inclusive of 0.08% and 0.14%), V: 0.15% to 0.30% (inclusive of 0.15% and 0.30%), Solute V: 0.04% to 0.1% (inclusive of 0.04% and 0.1%), Solute Ti: 0.05% or less, and remainder consisting of Fe and incidental impurities; (ii) microstructure with fine carbides dispersion precipitated therein, the fine carbides containing Ti and V and having the average particle diameter of less than 10 nm, as well as volume ratio with respect to the entire microstructure of at least 0.007; and matrix as ferrite phase having area ratio with respect to the entire microstructure of at least 97%, wherein contents of C, Ti, V, S and N satisfy formula (1) and formula (2) below.

$$Ti \geq 0.08+(N/14\times48+S/32\times48) \quad (1)$$

$$0.8 \leq (Ti/48+V/51)/(C/12) \leq 1.2 \quad (2)$$

In formulae (1) and (2), "C", "Ti", "V", "S" and "N" represent contents (mass %) of corresponding elements, respectively.

(2) The high tensile strength hot roiled steel sheet having excellent formability of (1) above, wherein the total content, by mass %, of the solute V and the solute Ti is at least 0.07%.

(3) The high tensile strength hot rolled steel sheet having excellent formability of (1) or (2) above, wherein the composition of the hot rolled steel sheet further includes by mass % at least one type of elements selected from Cr: 1% or less and B: 0.003% or less.

(4) The high tensile strength hot rolled steel sheet having excellent formability of any of (1) to (3) above, wherein the composition of the hot rolled steel sheet further includes by mass % at least one type of elements selected from Nb and Mo such that the total content thereof is equal to or lower than 0.01 mass %.

(5) A method for manufacturing a high tensile strength hot rolled steel sheet having excellent formability, comprising preparing a steel material, subjecting the steel material to hot rolling including rough rolling and finish rolling, cooling after completion of the finish rolling, and coiling to obtain a hot rolled steel sheet, the method is characterized in that it further comprises: preparing the steel material to have a composition including by mass %, C: 0.07% to 0.13% (inclusive of 0.07% and 0.13%), Si: 0.3% or less, Mn: 0.5% to 2.0% (inclusive of 0.5% and 2.0%), P: 0.025% or less, S: 0.005% or less, N: 0.0060% or less, Al: 0.06% or less, Ti: 0.08% to 0.14% (inclusive of 0.08% and 0.14%), V: 0.15% to 0.30% (inclusive of 0.15% and 0.30%), and remainder consisting of Fe and incidental impurities; setting finish rolling completing temperature in the finish rolling to be equal to or higher than 880° C.; and setting coiling temperature in the coiling to be 580° C. or higher, wherein contents of C, Ti, V, S and N satisfy formula (1) and formula (2) below.

$$Ti \geq 0.08+(N/14\times48+S/32\times48) \quad (1)$$

$$0.8 \leq (Ti/48+V/51)/(C/12) \leq 1.2 \quad (2)$$

In formulae (1) and (2), "C", "Ti", "V", "S" and "N" represent contents (mass %) of corresponding elements, respectively.

(6) The method for manufacturing a high tensile strength hot rolled steel sheet of (5) above, further comprising setting the average cooling rate in the cooling process to be at least 20° C./s ("C/s" represents "C/second" in the present invention).

(7) The method for manufacturing a high tensile strength hot rolled steel sheet of (5) or (6) above, wherein the composition of the steel material further includes by mass % at least one type of elements selected from Cr: 1% or less and B: 0.003% or less.

(8) The method for manufacturing a high tensile strength hot rolled steel sheet of any of (5) to (7) above, wherein the composition of the steel material further includes by mass % at least one type of elements selected from Nb and Mo such that the total content thereof is equal to or lower than 0.01 mass %.

Effect of the Invention

According to the present invention, it is possible to stably manufacture on an industrial scale a high tensile strength hot rolled steel sheet suitable for use in automobile parts, which high tensile strength hot roiled steel sheet has tensile strength (TS) of at least 980 MPa and excellent formability (elongation, strength-flange ability and optionally bending properties) which makes the steel sheet applicable to a material of a chassis member or the like to be formed to have complicated sectional configurations. The present invention therefore causes a significantly good effect in industrial terms.

BEST EMBODIMENT FOR CARRYING OUT THE INVENTION

The present invention will be described in detail hereinafter. First, the reasons for why microstructure of the steel sheet of the present invention is to be specified as described above will be described. The hot rolled steel sheet of the present invention is a steel sheet constituted of: microstructure with fine carbides dispersion precipitated therein, the fine carbides containing Ti and V and having the average particle diameter of less than 10 nm, as well as volume ratio with respect to the entire microstructure of at least 0.007; and matrix as ferrite phase having area ratio with respect to the entire microstructure of at least 97%.

Ferrite phase: at least 97% by area ratio with respect to the entire microstructure Formation of ferrite phase is essential in terms of ensuring good formability (elongation and stretch-flange ability) of a hot rolled steel sheet in the present invention. Constituting microstructure of a hot rolled steel sheet predominantly of ferrite phase having relatively low dislocation density and thus excellent ductility effectively improves elongation and stretch-flange ability of the hot rolled steel sheet. Constituting microstructure of a hot rolled steel sheet of ferrite single phase is preferable in terms of improving stretch-flange ability in particular. However, microstructure of a hot rolled steel sheet does not need to be fully constituted of ferrite single phase and the good effect of ferrite phase described above is sufficiently demonstrated when the microstructure is substantially constituted of ferrite single phase, i.e. area ratio of ferrite phase with respect to the entire microstructure is at least 97%. Accordingly, area ratio of ferrite phase with respect to the entire microstructure is to be at least 97%.

Examples of microstructures other than ferrite phase include cementite, pearlite phase, bainite phase, martensite phase, retained austenite phase and the like in the hot rolled steel sheet of the present invention. Presence of these microstructure other than ferrite phase is tolerated unless the total area ratio thereof with respect to the entire microstructure exceeds 3% or so.

Fine Carbides Containing Ti and V

Carbides containing Ti and V tend to be fine carbides having extremely small average particle diameter. The present invention, aiming at increasing strength of a hot rolled steel sheet through dispersion precipitation of fine carbides in the hot rolled steel sheet, thus utilizes fine carbides containing Ti and V as fine carbides to be dispersion-precipitated in a hot rolled steel sheet.

Titanium carbide not containing vanadium has been normally used when strength of a steel sheet is to be increased in the prior art. In contrast, the present invention characteristically employs carbides containing both Ti and V. Titanium exhibits strong tendency to form carbides. Ti carbide not containing V therefore tends to be coarsened and makes less contribution to increasing strength of a steel sheet than Ti carbide containing V, eventually necessitating adding a larger amount of Ti and forming a larger amount of Ti carbide to impart the steel sheet with desired strength (tensile strength: 980 MPa). However, excessive addition of Ti may deteriorate formability (elongation and stretch-flange ability) of a steel sheet, thereby making it impossible for the steel sheet to obtain excellent formability which allows the steel sheet to be applied to a material of a chassis member or the like to be formed to have complicated cross-sectional configurations.

Further, carbides in a steel material must be melted prior to hot rolling as described below when a hot rolled steel sheet of the present invention is manufactured. In this regard, melting all of titanium carbide necessitated to ensure desired strength (tensile strength: 980 MPa) of the hot rolled steel sheet requires very high slab heating temperature prior to hot rolling (equal to or higher than 1300° C.) in a case where the hot rolled steel sheet is to be imparted with the desired strength solely by titanium carbide. Such high slab heating temperature as described above significantly exceeds normal slab heating temperature prior to hot rolling and requires special facilities, thereby making it difficult to carry out the production by using already existing manufacturing facilities.

In view of this, the present invention employs composite carbide containing Ti and V as carbide to be dispersion-precipitated. Vanadium effectively suppresses coarsening of carbide because vanadium has less tendency to form carbide than titanium. Further, use of composite carbide containing Ti and V significantly lowers melting temperature of carbide, as compared with a case using carbide containing Ti only, because combining both Ti with V very effectively drops melting temperature of carbide. That is, use of composite carbide containing Ti and V as carbide to be dispersion-precipitated is very advantageous in terms of production efficiency because the carbide melts at normal slab heating temperature prior to hot rolling even in a case where a large amount of carbide is to be dispersion precipitated for the purpose of imparting a hot rolled steel sheet with desired strength (tensile strength: at least 980 MPa).

"Fine carbides containing Ti and V" do not mean mixture of Ti carbides and V carbides respectively contained in microstructure but represent composite carbides each containing both Ti and V within one fine carbide particle.

Average Particle Diameter of Fine Particle: Less Than 10 nm

The average particle diameter of fine carbides is very important in terms of imparting a hot rolled steel sheet with desired strength (tensile strength: at least 980 MPa). The average particle diameter of fine carbides containing Ti and V is to be less than 10 nm in the present invention. Fine carbides precipitated in matrix of a hot rolled steel sheet function as resistance against dislocation motion occurring when a steel sheet is deformed, thereby increasing strength of the hot rolled steel sheet, and this strength-increasing effect of fine carbides is conspicuous when the average particle diameter of the fine carbides is less than 10 nm. Accordingly, the average particle diameter of fine carbides containing Ti and V is to be less than 10 nm and preferably 5 nm or less.

Volume Ratio of Fine Carbides with Respect to the Entire Microstructure: at Least 0.007

A dispersion-precipitated state of fine carbides containing Ti and V is also very important in terms of imparting a hot rolled steel sheet with desired strength (tensile strength: at least 980 MPa). Fine carbides containing Ti and V and having the average particle diameter of less than 10 nm are dispersion-precipitated such that fraction in microstructural terms of the fine carbides with respect to the entire microstructure is at least 0.007 in the present invention. In a case where this fraction is less than 0.007, it is difficult to reliably obtain desired strength (tensile strength: at least 980 MPa) of a hot rolled steel sheet, although the average particle diameter of fine carbides containing Ti and V is less than 10 nm in the hot rolled steel sheet. Accordingly, the fraction is to be at least 0.007 and preferably at least 0.008.

Precipitation morphology of fine carbides containing Ti and V in the present invention includes a state in which randomly-precipitated fine carbides exist in a mixed manner, as well as a main precipitation state in which fine carbides are precipitated in row. The former randomly-precipitated state causes no adverse effect on the properties of a hot rolled steel sheet. Morphology of precipitation therefore does not matter and various types of precipitation states may be collectively referred to as "dispersion precipitation" in the present invention.

Next, reasons for why chemical compositions of the hot rolled steel sheet of the present invention are to be restricted as mentioned above will be described. "% associated with each of following chemical compositions represents mass % unless specified otherwise.

C: 0.07% to 0.13% (Inclusive of 0.07% and 0.13%)

Carbon is an essential element in terms of forming fine carbides and increasing strength of a hot rolled steel sheet. Carbon content in steel less than 0.07% makes it impossible to reliably obtain fine carbides at desired microstructural fraction in a resulting hot rolled steel sheet, whereby the steel sheet cannot have tensile strength of at least 980 MPa. However, carbon content in steel exceeding 0.13% causes troubles such as difficulty in spot welding. Accordingly, carbon content in steel is to be in the range of 0.07% to 0.13% (inclusive of 0.07% and 0.13%) and preferably in the range of 0.08% to 0.12% (inclusive of 0.08% and 0.12%).

Si: 0.3% or Less

Silicon content in steel exceeding 0.3% facilitates precipitation of carbon from ferrite phase and precipitation of coarse Fe carbide at grain boundaries, thereby deteriorating stretch-flange ability of a resulting hot rolled steel sheet. Further, Si content in steel exceeding 0.3% increases rolling road during hot rolling to render shape of a rolled material unsatisfactory.

Accordingly, Si content in steel is to be 0.3% or less, preferably 0.15% or less, and more preferably 0.05% or less.

Mn: 0.5% to 2.0% (Inclusive of 0.5% and 2.0%)

Manganese is a solute strengthening element and effectively increases strength of a steel sheet. Manganese content in steel is preferably at least 0.5% in terms of increasing strength of a hot rolled steel sheet. However, Mn content in steel exceeding 2.0% results in apparent manganese segregation and formation of a phase other than ferrite phase, i.e. formation of a hard phase, thereby deteriorating stretch-flange ability of a resulting hot rolled steel sheet. Accordingly, Mn content in steel is to be in the range of 0.5% to 2.0% (inclusive of 0.5% and 2.0%) and preferably in the range of 1.0% to 2.0% (inclusive of 1.0% and 2.0%).

P: 0.025% or Less

Phosphorus content in steel exceeding 0.025% results in apparent phosphorus segregation to deteriorate stretch-flange ability of a resulting hot rolled steel sheet. Accrodingly, phosphorus content in steel is to be 0.025% or less and preferably 0.02% or less.

S: 0.005% or Less

Sulfur is an element which deteriorates hot formability (hot rolling formability), makes a slab susceptible to hot cracking, and forms MnS in steel to deteriorate formability (stretch-flange ability) of a hot rolled steel sheet. Accordingly, sulfur content in steel is preferably reduced as best as possible in the present invention. Sulfur content in steel is to be 0.005% or less and preferably 0.003% or less.

N: 0.0060% or Less

Nitrogen is a harmful element and content thereof in steel is preferably reduced as best as possible in the present invention. Nitrogen content exceeding 0.0060% results in formation of coarse nitride in steel, which eventually deteriorates stretch-flangeability. Accordingly, nitrogen content in steel is to be 0.0060% or less.

Al: 0.06% or Less

Aluminum is an element which functions as a deoxidizing agent. Aluminum content in steel is preferably at least 0.001% to sufficiently obtain the deoxidizing effect of aluminum. However, Al content in steel exceeding 0.06% deteriorates elongation and stretch-flange ability of a resulting hot rolled steel sheet. Accordingly, aluminum content in steel is to be 0.06% or less.

Ti: 0.08% to 0.14% (Inclusive of 0.08% and 0.14%)

Titanium is one of the important elements in the present invention. Titanium is an element which forms composite carbide with vanadium to contribute to increasing strength of a steel sheet with maintaining excellent elongation and stretch-flange ability thereof. Titanium content in steel less than 0.08% cannot ensure desired strength (tensile strength: at least 980 MPa) of a hot rolled steel sheet. However, Ti content in steel exceeding 0.14% deteriorates stretch-flange ability of a hot rolled steel sheet. Further, Ti content in steel exceeding 0.14% possibly results in a situation in which carbides fail to melt unless slab heating temperature prior to hot rolling is raised to 1300° C. or higher when a hot rolled steel sheet is manufactured. Yet further, Ti content in steel exceeding 0.14% results in a plateau of increase in fraction of fine carbides precipitated in the microstructure, i.e. a situation where the Ti-addition effect fails to increase in spite of increase in Ti content. Titanium content in steel is therefore to be in the range of 0.08% to 0.14% (inclusive of 0.08% and 0.14%).

V: 0.15% to 0.30% (Inclusive of 0.15% and 0.30%)

Vanadium is one of the important elements in the present invention. Vanadium is an element which forms composite carbide with titanium to contribute to increasing strength of a steel sheet with maintaining excellent elongation and stretch-flange ability thereof. Vanadium content in steel less than 0.15% cannot ensure desired strength (tensile strength: at least 980 MPa) of a steel sheet. However, V content in steel exceeding 0.30% makes center segregation thereof apparent, thereby deteriorating elongation and/or toughness of a resulting hot rolled steel sheet. Accordingly, vanadium content in steel is to be in the range of 0.15% to 0.30% (inclusive of 0.15% and 0.30%). In the hot rolled steel sheet of the present invention, contents of C, N, S. Ti and V are controllably set so as to satisfy the aforementioned ranges and formula (1) and formula (2) below, respectively.

$$Ti \geq 0.08+(N/14\times48+S/32\times48) \quad (1)$$

$$0.8 \leq (Ti/48+V/51)/(C/12) \leq 1.2 \quad (2)$$

In formulae (1) and (2), "C", "Ti", "V", "S" and "N" represent contents (mass %) of corresponding elements, respectively. The aforementioned formula (1) and formula (2) are requirements to be satisfied to realize the desired precipitation state of fine carbides containing Ti and V described above and thus very important indices in the present invention.

$$Ti \geq 0.08+(N/14\times48+S/32\times48) \quad (1)$$

Fine carbides containing Ti and V are dispersion-precipitated in a hot rolled steel sheet in the present invention, as described above. These fine carbides, in a steel material, are melted when the steel material is heated prior to hot rolling and then precipitated during subsequent hot rolling, cooling after the hot rolling, and coiling. The fine carbides are formed such that Ti is first precipitated as nucleus and then V is precipitated to form a composite therewith. In view of this, ensuring sufficient content of titanium as precipitation nucleus is necessary in order to make the fine carbides be stably precipitated as fine carbides having the average particle diameter of 10 nm or less to realize the target volume ratio of at least 0.007 of the dispersion-precipitated fine carbides with respect to the entire microstructure of an eventually obtained hot rolled steel sheet.

Contents of Ti, N and S in steel are therefore to be controllably set to satisfy formula (1), i.e. $Ti \geq 0.08+(N/14\times48+S/32\times48)$. Setting contents of Ti, N and S in steel to satisfy formula (1) ensures sufficient content of Ti as precipitation nuclei of fine carbides, makes the fine carbides be stably precipitated as fine carbides having the average particle diameter of 10 nm or less, and thus realizes dispersion precipitation in which volume ratio of the fine carbides with respect to the entire microstructure of an eventually obtained hot rolled steel sheet is at least 0.007. For the reasons described above, contents of Ti, N and S in steel as a material of the hot rolled steel sheet are controllably set to satisfy formula (1), i.e. $Ti \geq 0.08+(N/14\times48+S/32\times48)$, in the present invention.

$$0.8 \leq (Ti/48+V/51)/(C/12) \leq 1.2 \quad (2)$$

It is also important to controllably set ratio of (Ti and V) contents with respect to C content in steel to an adequate range in the present invention. Too high ratio of (Ti and V) contents with respect to C content in steel results in precipitation of pearlite phase and coarsening of carbide in a hot rolled steel sheet, which adversely affects elongation and stretch-flange ability of the hot rolled steel sheet. Too low ratio of (Ti and V) contents with respect to C content in steel makes it difficult to sufficiently obtain fine carbides containing Ti and V necessitated to ensure desired strength (tensile strength: at least 980 MPa) of a steel sheet. Accordingly, contents of Ti, V and C in steel as a material of the hot rolled steel sheet are controllably set to satisfy formula (2), i.e. $0.8 \leq (Ti/48+V/51)/(C/12) \leq 1.2$, in the present invention.

Solute V: 0.04% to 0.1% (inclusive of 0.04% and 0.1%)

Solute vanadium effectively functions to improve stretch-flange ability of a hot rolled steel sheet. In a case where content of solute V among vanadium contained in a hot rolled steel sheet is less than 0.04%, the aforementioned good effect of vanadium is not sufficiently demonstrated and a resulting hot rolled steel sheet cannot reliably have stretch-flange ability good enough for application to a material of a chassis member or the like to be formed to have complicated cross-sectional configurations. In a case where the content of solute V exceeding 0.1%, not only the good effect of vanadium reaches a plateau but also fine carbides containing Ti and V necessitated to ensure desired strength (tensile strength: at least 980 MPa) of a steel sheet may not be sufficiently obtained. Accordingly, content of solute V among vanadium contained in a hot rolled steel sheet is to be in the range of 0.04% to 0.1% (inclusive of 0.04% and 0.1%), preferably in the range of 0.04% to 0.07% (inclusive of 0.04% and 0.07%), and more preferably in the range of 0.04% to 0.06% (inclusive of 0.04% and 0.06%).

Solute Ti: 0.05% or Less

The hot rolled steel sheet of the present invention contains solute V by desired content in order to ensure good stretch-flange ability of the hot rolled steel sheet as described above. Solute titanium does not cause such a good effect as solute V does and presence of solute Ti rather means that content of Ti effectively functioning as precipitation nucleus has been decreased accordingly. Content of solute Ti is therefore to be 0.05% or less, preferably 0.03% or less, and more preferably 0.02% or less to ensure desired strength (tensile strength: at least 980 MPa) of the resulting steel sheet.

Total Content of Solute V and Solute Ti: at Least 0.07%

Grain boundaries of steel is strengthened and bending properties of a resulting steel sheet improves by setting the total content of solute V and solute Ti present in ferrite phase to be at least 0.07%. In view of this, it is preferable to set contents of solute V and solute Ti to be in the aforementioned corresponding ranges, respectively, and adjust the total content of solute V and solute Ti to at least 0.07%. In a case where the total content of solute V and solute Ti is lower than 0.07%, the desired effect of strengthening grain boundaries and improving bending properties described above cannot be obtained. In a case where the total content of solute V and solute Ti is too high, fine carbides containing Ti and V may not be sufficiently precipitated. Accordingly, the total content of solute V (0.04% to 0.1%, inclusive of 0.04% and 0.1%) and solute Ti (0.05% or less) is to be 0.15% or less. The total content of solute V and solute Ti is preferably 0.10% or less in terms of effectively utilizing V and Ti contained in a steel sheet.

The composition of the hot rolled steel sheet of the present invention may contain, in addition to the basic compositions described above, at least one type of element selected from Cr: 1% or less and B: 0.003% or less. Chromium and boron are elements each functioning to increase strength of steel and may be selected and included in the composition according to necessity.

Cr: 1% or Less

Chromium is an element which in solute state effectively strengthens ferrite phase. Chromium content in steel is preferably at least 0.05% in order to obtain such a good effect of chromium as described above. However, Cr content in steel exceeding 1% is not economical because the good effect of Cr then reaches a plateau. Accordingly, Cr content in steel is preferably 1% or less.

B: 0.003% or Less

Boron is an element which effectively lowers the Ara transformation point of steel and may be utilized to adjust area ratio of ferrite phase with respect to the entire microstructure during cooling process in hot rolling. However, a good effect of boron reaches a plateau when boron content in steel exceeds 0.003%. Accordingly, boron content in steel is preferably 0.003% or less. Content of boron, in a case where it is utilized, is preferably at least 0.0005% to reliably obtain the good effect thereof.

The composition of the hot rolled steel sheet of the present invention may contain by mass %, in addition to the basic compositions described above, at least one type of element selected from Nb and Mo such that the total content thereof is equal to or lower than 0.01 mass %. The composition may include Nb and Mo according to necessity because Nb and Mo are compositely precipitated with Ti and V to form composite carbide, thereby contributing to obtaining desired strength of a steel sheet. The total content of Nb and Mo is preferably at least 0.005% in order to sufficiently obtain the good effect of Nb and Mo. However, too high total content of Nb and Mo tends to deteriorate elongation of a resulting steel sheet. Accordingly, the composition preferably contains at least one of Nb and Mo such that the total content thereof is 0.01% or less.

Components other than those described above are Fe and incidental impurities in the hot rolled steel sheet of the present invention. Examples of the incidental impurities include 0, Cu, Sn, Ni, Ca, Co, As and the like. Presence of these impurities is tolerated unless contents thereof exceed 0.1%. Contents of these impurities are preferably 0.03% or less.

Next, a method for manufacturing a hot rolled steel sheet of the present invention will be described.

The method of the present invention basically includes preparing a steel material, subjecting the steel material to hot rolling including rough rolling and finish rolling, cooling after completion of the finish rolling, and coiling to obtain a hot rolled steel sheet. The method preferably further includes: setting finish rolling completing temperature in the finish rolling to be equal to or higher than 880° C.; and setting coiling temperature in the coiling to be 580° C. or higher. The method preferably yet further includes setting the average cooling rate in the cooling process after the hot rolling to be at least 20° C./s.

The smelting technique for preparing a steel material is not particularly restricted and any of the known smelting techniques such as a converter, an electric furnace or the like can be employed in the present invention. A slab (the steel material) is preferably prepared by continuous casting after smelting process in view of problems such as possible segregation, although a slab may be prepared by a known casting method such as ingot casting-rolling (blooming), thin slab continuous casting or the like. When a cast slab is hot rolled, the slab may be either rolled after being reheated by a heating furnace or immediately rolled without being reheated when the temperature of the slab is kept at predetermined temperature or higher.

The steel material thus obtained is then subjected to rough rolling and finish rolling. Carbides contained in the steel material must be melted prior to rough rolling in the present invention. The steel material is heated in this regard to temperature preferably in the range of 1150° C. to 1280° C. (inclusive of 1150° C. and 1280° C.) because the steel material of the present invention contains Ti and V as carbide-forming elements. This process of heating a steel material prior to rough rolling may be omitted in a case where the steel material prior to rough rolling is kept at temperature equal to or higher than predetermined temperature and carbides in the steel material have been melted as described above. Conditions of rough rolling need not be particularly restricted.

Finish rolling completing temperature: 880° C. or higher

Adequately setting finish rolling completing temperature is important in terms of ensuring good elongation and stretch-flange ability of a hot rolled steel sheet and decreasing rolling load in finish rolling. Finish rolling completing temperature lower than 880° C. results in coarse crystal grains at surface layers of a hot rolled steel sheet, which deteriorate elongation and stretch-flange ability of the steel sheet. Further, when finish rolling completing temperature is lower than 880° C., magnitude of accumulated strains introduced into a rolled material increases because rolling is carried out in non-recrystallization temperature region; and rolling load significantly increases as the magnitude of accumulated strains increases, thereby making it difficult to reduce thickness of a hot roiled steel sheet. Accordingly, finish rolling completing temperature is to be 880° C. or higher and preferably 900° C. or higher. However, finish rolling completing temperature is preferably 1000° C. or lower because too high finish rolling completing temperature coarsens crystal grains of a steel sheet to cause an adverse effect on obtaining desired strength (tensile strength: at least 980 MPa) in the steel sheet.

Coiling Temperature: 580° C. or Higher

Adequately setting coiling temperature in the coiling process is very important in terms of obtaining desired microstructure across the entire steel sheet in the widthwise direction in an eventually obtained hot rolled steel sheet, which desired microstructure includes: fine carbides dispersion-precipitated therein, the fine carbides containing Ti and V and having the average particle diameter of less than 10 nm, as well as volume ratio with respect to the entire microstructure of at least 0.007; and matrix as ferrite phase having area ratio with respect to the entire microstructure of at least 97%.

Coiling temperature lower than 580° C.: causes fine carbides to be insufficiently precipitated at end portions in the widthwise direction of a rolled material, which portions are susceptible to excessive cooling, thereby making it impossible to impart the eventually obtained hot rolled steel sheet with desired strength (tensile strength: 980 MPa or higher); and problematically deteriorates running stability on a run-out table. Accordingly, coiling temperature is to be 580° C. or higher. Coiling temperature is preferably equal to or lower than 700° C. in terms of suppressing formation of pearlite phase. "Coiling temperature" represents coiling temperature actually measured at the center portion in the widthwise direction of a rolled material or coiling temperature at the center portion in the widthwise direction of the rolled material calculated through simulation or the like in the present invention.

Cooling after completion of finish rolling down to the coiling temperature is preferably carried out at the average cooling rate of at least 20° C./s.

When the average cooling rate in cooling after completion of finish rolling from temperature equal to or higher than 880° C. down to the coiling temperature is lower than 20° C./s, the $Ar_3$ transformation point tends to be high and carbides are likely to be coarsened, whereby consumption of solute V and solute Ti in steel is facilitated, which solute V and solute Ti would otherwise effectively improve bending properties of a resulting steel sheet. Further, the average cooling rate from temperature equal to or higher than 880° C. clown to the coiling temperature is preferably set to be at least 20° C./s, more preferably at least 30° C./s, to ensure that the total content of solute V and solute Ti is at least 0.07% (the total content of solute V and solute Ti is preferably at least 0.07% in terms of achieving good bending properties as described above). The upper limit of the average cooling rate is preferably 60° C./s in terms of preventing uneven cooling from occurring, although the upper limit is not particularly restricted.

It is necessary, in order to manufacture a high tensile strength hot rolled steel sheet having tensile strength (TS) of at least 980 MPa and excellent formability (elongation and stretch-flange ability) applicable to a material of a chassis member or the like to be formed to have complicated cross-sectional configurations, to cause fine carbides having the average particle diameter of 10 nm or less to be dispersion-precipitated at desired volume ratio thereof (at least 0.007) with respect to the entire microstructure of the hot rolled steel sheet across the entire steel sheet in the widthwise direction.

In this regard, composition of a steel material of the hot roiled steel sheet is controlled in the present invention such that Ti content is equal to or higher than a predetermined content determined according to contents of N and S in the steel material (i.e. $Ti \geq 0.08+(N/14\times48+S/32\times48)$ and that contents of C, Ti and V in the steel material satisfy a predetermined relationship $(0.8 \leq (Ti/48+V/51)/(C/12) \leq 1.2)$, so that fine carbides having the average particle diameter of 10 nm are dispersion-precipitated sufficiently. As a result, in manufacturing a hot roiled steel sheet according to the present invention, fine carbides having the average particle diameter of 10 nm or less can be dispersion-precipitated at the desired volume ratio (at least 0.007) and satisfactory properties (tensile strength, elongation, stretch-flange ability) are uniformly ensured across the entire steel sheet in the widthwise direction of the hot rolled steel sheet.

Further, a hot rolled steel sheet is imparted with good bending properties by setting the total content of solute V and solute Ti to be a predetermined range by adjusting cooling conditions after completion of finish rolling in the present invention.

EXAMPLES

Experiment 1

Each of molten steel samples having respective compositions shown in Table 1 was subjected to smelting and continuous casting by the conventional known techniques to obtain a slab (a steel material) having 250 mm thickness. The slab was subjected to heating at 1250° C., rough rolling, finish rolling at the corresponding finish rolling completing temperature shown in Table 2, and coiling at the corresponding coiling temperature shown in Table 2, whereby a hot rolled steel sheet sample having sheet thickness: 2.3 mm was obtained.

TABLE 1

| Steel | Chemical composition (mass %) | | | | | | | | | | Formula | Formula | |
|---|---|---|---|---|---|---|---|---|---|---|---|---|---|
| sample | C | Si | Mn | P | S | N | Al | Ti | V | Others | (1) | (2) | Note |
| A | 0.096 | 0.02 | 1.51 | 0.011 | 0.0008 | 0.0031 | 0.046 | 0.112 | 0.287 | — | 0.092 | 0.995 | Example |
| B | 0.092 | 0.01 | 1.52 | 0.010 | 0.0007 | 0.0043 | 0.043 | 0.131 | 0.227 | Cr: 0.24 | 0.096 | 0.937 | Example |
| C | 0.093 | 0.02 | 1.03 | 0.012 | 0.0009 | 0.0050 | 0.044 | 0.124 | 0.261 | — | 0.098 | 0.994 | Example |
| D | 0.075 | 0.02 | 1.49 | 0.010 | 0.0008 | 0.0033 | 0.044 | 0.138 | 0.233 | — | 0.093 | 1.191 | Example |
| E | 0.112 | 0.01 | 1.36 | 0.010 | 0.0009 | 0.0022 | 0.043 | 0.134 | 0.298 | B: 0.0023 | 0.089 | 0.925 | Example |
| F | 0.062 | 0.01 | 1.36 | 0.011 | 0.0007 | 0.0031 | 0.042 | 0.096 | 0.154 | — | 0.092 | 0.972 | Comp. Example |
| G | 0.087 | 0.02 | 1.53 | 0.011 | 0.0027 | 0.0079 | 0.041 | 0.104 | 0.244 | — | 0.111 | 0.959 | Comp. Example |
| H | 0.094 | 0.02 | 1.07 | 0.010 | 0.0007 | 0.0033 | 0.041 | 0.067 | 0.269 | — | 0.092 | 0.852 | Comp. Example |
| I | 0.076 | 0.02 | 1.34 | 0.009 | 0.0009 | 0.0029 | 0.043 | 0.136 | 0.090 | — | 0.091 | 0.726 | Comp. Example |

Formula (1): 0.08 + (N/14 × 48 + S/32 × 48)

Formula (2): (Ti/48 + V/51)/(C/12)

"Example" represents Example according to the present invention.

TABLE 2

| Steel sample ID | Hot rolled sheet sample No. | Production conditions of hot rolled sheet: Finish rolling completing temperature | Production conditions of hot rolled sheet: Coiling temperature (° C.) | Note |
|---|---|---|---|---|
| A | 1 | 911 | 582 | Example |
| | 2 | 898 | 624 | Example |
| | 3 | 913 | 526 | Comp. Example |
| | 4 | 865 | 613 | Comp. Example |
| B | 5 | 902 | 622 | Example |
| C | 6 | 924 | 604 | Example |
| | 7 | 903 | 619 | Example |
| | 8 | 853 | 452 | Comp. Example |
| D | 9 | 919 | 597 | Example |
| E | 10 | 906 | 599 | Example |
| F | 11 | 912 | 621 | Comp. Example |
| G | 12 | 908 | 609 | Comp. Example |
| H | 13 | 922 | 592 | Comp. Example |
| I | 14 | 898 | 623 | Comp. Example |

Test pieces were collected from each of the hot rolled steel sheet samples thus obtained. These test pieces were subjected to microstructural observation, a tensile test and a hole-expansion test, whereby area ratio of ferrite phase, the average particle diameter and volume ratio of fine carbides containing Ti and V, content of solute V, content of solute Ti, tensile strength, total elongation, and hole expansion ratio (stretch-flange ability) were determined. Testing methods were as follows.

(i) Microstructural Observation

A test piece was collected from the center portion in the sheet widthwise direction of each of the hot rolled steel sheet samples thus obtained. A cross section in the rolling direction of the test piece, which had been mechanically polished and etched with nital solution, was photographed by using a scanning electron microscope (SEM) at magnification of ×3000 to obtain a photograph of microstructure (a SEM photograph). The photograph of microstructure was analyzed by using an image analyzer to identify ferrite phase and the phases other than ferrite phase and determine respective area ratios of these phases.

A thin film was prepared from each of the hot rolled steel sheet samples. The thin film was observed by using a transmission electron microscope (TEM) to determine particle diameters and volume ratio of fine carbides containing Ti and V. Further, content of solute Ti and content of solute V were determined by: treating a test piece of each hot rolled steel sheet sample with 10% acetylacetone-1% tetramethylammonium-methanol solution as electrolytic solution to obtain extraction residue; chemically analyzing the extraction residue to determine Ti content and Vi content as precipitates, respectively; and subtracting the Ti content and the Vi content as precipitates thus determined from the total Ti content and the total V content, respectively, to determine content of solute Ti and content of V.

(ii) Tensile Test

A JIS No. 5 tensile test piece (JIS Z 2201), of which tensile direction coincided with the direction orthogonal to the rolling direction, was collected from each of the hot rolled steel sheet samples thus obtained. Tensile tests were carried out by using the test piece according to JIS Z 2241 to determine tensile strength (TS) and total elongation (El) of the test piece.

(iii) Hole Expansion Test

A test piece (size: 130 mm×130 mm) was collected from each of the hot rolled steel sheet samples thus obtained and a hole (the initial diameter $d_0$: 10 mm ϕ)) was formed by punching in the test piece. A hole expansion test was carried out by using the test piece thus punched by: inserting a cone-shaped punch having apex angle of 60° into the hole to expand the hole; measuring diameter d of the hole when a crack penetrated through the steel sheet (the test piece); and calculating hole expansion ratio λ (%) according to formula below.

$$\text{Hole expansion ratio } \lambda(\%)=\{(d-d_0)/d_0\}\times 100$$

The obtained results are shown in Table 3.

TABLE 3

| Steel sample ID | Hot rolled sheet sample No. | Composition of hot: Content of solute Ti (mass %) | Composition of hot: Content of solute V (mass %) | Microstructure of hot rolled steel sheet: Ferrite phase *1 Area ratio (%) | Microstructure of hot rolled steel sheet: Ti—V based fine carbide *2: Average particle diameter (nm) | Microstructure of hot rolled steel sheet: Ti—V based fine carbide *2: Volume ratio | Mechanical properties of hot rolled: Tensile strength (TS) (MPa) | Mechanical properties of hot rolled: Total elongation (El) (%) | Mechanical properties of hot rolled: Hole expansion ratioλ (%) | Note |
|---|---|---|---|---|---|---|---|---|---|---|
| A | 1 | 0.020 | 0.060 | 97.8 | 6 | 0.0086 | 1034 | 16.0 | 45.0 | Example |
| | 2 | 0.011 | 0.059 | 98.1 | 5 | 0.0090 | 1052 | 16.2 | 43.7 | Example |
| | 3 | 0.062 | 0.085 | 97.3 | 6 | 0.0061 | 902 | 17.1 | 62.3 | Comp. Example |
| | 4 | 0.016 | 0.053 | 98.4 | 15 | 0.0072 | 934 | 16.8 | 56.7 | Comp. Example |
| B | 5 | 0.007 | 0.062 | 97.6 | 4 | 0.0087 | 1029 | 16.7 | 44.5 | Example |
| C | 6 | 0.024 | 0.055 | 98.6 | 4 | 0.0088 | 1036 | 16.5 | 43.8 | Example |
| | 7 | 0.017 | 0.063 | 98.7 | 3 | 0.0091 | 1056 | 16.9 | 42.7 | Example |
| | 8 | 0.025 | 0.068 | 92.1 | 11 | 0.0083 | 897 | 14.6 | 35.7 | Comp. Example |
| D | 9 | 0.031 | 0.064 | 98.2 | 5 | 0.0079 | 997 | 16.2 | 42.8 | Example |
| E | 10 | 0.022 | 0.057 | 98.3 | 4 | 0.0092 | 1053 | 16.3 | 43.6 | Example |
| F | 11 | 0.063 | 0.084 | 97.8 | 5 | 0.0059 | 893 | 18.6 | 58.4 | Comp. Example |
| G | 12 | 0.043 | 0.072 | 98.2 | 6 | 0.0063 | 925 | 17.3 | 45.2 | Comp. Example |
| H | 13 | 0.013 | 0.078 | 97.5 | 5 | 0.0057 | 951 | 16.9 | 46.7 | Comp. Example |
| I | 14 | 0.014 | 0.022 | 97.5 | 4 | 0.0056 | 938 | 17.4 | 32.0 | Comp. Example |

*1: Area ratio with respect to the entire microstructure (%)

*2: Fine carbide containing Ti and V, of which "Volume ratio" represents volume ratio with respect to the entire microstructure Examples according to the present invention of Experiment 1 unanimously realized hot rolled steel sheets each having sufficiently high strength (tensile strength TS: at least 980 MPa) and excellent formability (total elongation El: at least 15%, and hole expansion ratio λ: at least 40%). In contrast, each of Comparative Examples beyond the scope of the present invention exhibits at least one of: failure in ensuring predetermined high strength; and failure in ensuring desired total elongation El and/or hole expansion ratio λ.

For some of the hot rolled steel sheet samples thus obtained, JIS No. 5 tensile test pieces were collected from vicinities of end portions in the sheet widthwise direction thereof (i.e. edge portions), as well as the aforementioned center portion in the sheet widthwise direction, in the same manner as described above for an additional tensile test. The results of comparing the tensile strength (TS) measured at the center portion in the sheet widthwise direction, with the tensile strength (TS) measured in the vicinity of an end portion (i.e. an edge portion) in the sheet widthwise direction, are shown for the relevant Examples in Table 4.

It is understood from the results shown in Table 4 that the hot rolled steel sheets of the present invention each exhibit sufficiently high tensile strength TS at both the center portion and the vicinity of an end portion (an edge portion) in the sheet widthwise direction thereof, i.e. demonstrate excellent properties at end portions in the sheet widthwise direction thereof, as well.

Experiment 2

Each of molten steel samples having respective compositions shown in Table 5 was subjected to smelting and continuous casting by the conventionally known techniques to obtain a slab (a steel material) having 250 mm thickness. The slab was subjected to heating at 1250° C., rough rolling, finish rolling at the corresponding finish rolling completing temperature shown in Table 6, cooling (from the finish rolling completing temperature down to the coiling temperature) at the corresponding average cooling rate shown in Table 6, and coiling

TABLE 4

| Steel sample ID | Hot rolled sheet sample No. | Production conditions of hot rolled sheet: Finish rolling completing temperature (° C.) | Production conditions of hot rolled sheet: Coiling temperature (° C.) | Tensile strength (TS) (MPa): Center portion*3 | Tensile strength (TS) (MPa): Edge portion*4 | Note |
|---|---|---|---|---|---|---|
| A | 1 | 911 | 582 | 1034 | 1022 | Example |
| C | 6 | 924 | 604 | 1036 | 1034 | Example |
| D | 9 | 919 | 597 | 997 | 995 | Example |

*3Center portion in the sheet widthwise direction

*4Vicinity of end portion in the sheet widthwise direction (edge portion)

at the corresponding coiling temperature shown in Table 6, whereby a hot rolled steel sheet sample having sheet thickness: 2.3 mm was obtained.

TABLE 5

| Steel sample | Chemical composition (mass %) C | Si | Mn | P | S | N | Al | Ti | V | Others | Formula (1) | Formula (2) | Note |
|---|---|---|---|---|---|---|---|---|---|---|---|---|---|
| J | 0.093 | 0.01 | 1.48 | 0.010 | 0.0007 | 0.0032 | 0.045 | 0.116 | 0.242 | Nb: 0.005 | 0.092 | 0.924 | Example |
| K | 0.086 | 0.01 | 1.51 | 0.012 | 0.0009 | 0.0041 | 0.042 | 0.128 | 0.251 | Cr: 0.17 | 0.095 | 1.059 | Example |
| L | 0.099 | 0.01 | 1.49 | 0.011 | 0.0008 | 0.0037 | 0.052 | 0.136 | 0.239 | — | 0.094 | 0.911 | Example |
| M | 0.081 | 0.01 | 1.38 | 0.011 | 0.0007 | 0.0039 | 0.043 | 0.134 | 0.241 | Mo: 0.006 | 0.094 | 1.114 | Example |
| N | 0.103 | 0.02 | 1.62 | 0.012 | 0.0009 | 0.0028 | 0.049 | 0.129 | 0.287 | B: 0.0013 | 0.091 | 0.969 | Example |
| O | 0.091 | 0.01 | 1.45 | 0.010 | 0.0008 | 0.0031 | 0.038 | 0.131 | 0.206 | — | 0.092 | 0.893 | Example |

Formula (1): 0.08 + (N/14 × 48 + S/32 × 48)
Formula (2): (Ti/48 + V/51)/(C/12)

TABLE 6

| Steel sample ID | Hot rolled sheet sample No. | Production conditions of hot rolled sheet: Finish rolling completing temperature (° C.) | Average cooling rate (° C./s) | Coiling temperature (° C.) | Note |
|---|---|---|---|---|---|
| J | 1A | 902 | 25 | 596 | Example |
| | 2A | 911 | 22 | 633 | Example |
| | 3A | 925 | 15 | 624 | Example |
| K | 4A | 905 | 24 | 638 | Example |
| | 5A | 897 | 35 | 594 | Example |
| | 6A | 915 | 16 | 657 | Example |
| L | 7A | 900 | 31 | 590 | Example |
| | 8A | 899 | 26 | 625 | Example |
| | 9A | 905 | 11 | 597 | Example |
| M | 10A | 903 | 36 | 618 | Example |
| | 11A | 916 | 37 | 623 | Example |
| | 12A | 921 | 16 | 605 | Example |
| N | 13A | 908 | 41 | 599 | Example |
| | 14A | 889 | 29 | 648 | Example |
| | 15A | 911 | 14 | 634 | Example |
| O | 16A | 906 | 33 | 627 | Example |
| | 17A | 897 | 36 | 613 | Example |
| | 18A | 912 | 16 | 607 | Example |

Test pieces were collected from each of the hot rolled steel sheet samples thus obtained. These test pieces were subjected to microstructural observation, a tensile test and a hole-expansion test as in Experiment 1, whereby area ratio of ferrite phase, the average particle diameter and volume ratio of fine carbides containing Ti and V, content of solute V, content of solute Ti, tensile strength, total elongation, and hole expansion ratio (stretch-flange ability) were determined.

Further, a bending test piece was collected from each of the hot rolled steel sheet samples thus obtained. The bending test piece was subjected to a bending test. Testing conditions were as follows.

(iv) Bending Test

Bending test pieces (30 mm×150 mm each) was collected from each of the hot rolled steel sheet samples thus obtained such that the longitudinal direction of each test piece was oriented orthogonal to the rolling direction. The bending test pieces were subjected to a V-block bend test (bending angle: 90°) according to JIS Z 2248. The test was carried out for three test pieces, respectively, by: measuring the smallest bending radius R (mm) at which generation of crack was narrowly avoided; dividing R by the sheet thickness t (mm); and regarding R/t as the limit bending radius.

The obtained results are shown in Table 7.

TABLE 7

| Steel sample ID | Hot rolled sheet sample No. | Composition of hot rolled steel sheet: Content of solute Ti (mass %) | Content of solute V (mass %) | Total content of solute Ti and solute V (mass %) | Microstructure of hot rolled steel sheet: Ferrite phase *1 Area ratio (%) | Ti—V based fine carbide *2 Average particle diameter (nm) | Volume ratio | Mechanical properties of hot rolled steel sheet: Tensile strength (TS) (MPa) | Total elongation (El) (%) | Hole expansion ratioλ (%) | Limit bending radius R/t | Note |
|---|---|---|---|---|---|---|---|---|---|---|---|---|
| J | 1A | 0.021 | 0.068 | 0.089 | 97.7 | 5 | 0.0087 | 1025 | 16.1 | 45.1 | 0.41 | Example |
| | 2A | 0.018 | 0.082 | 0.100 | 98.3 | 4 | 0.0091 | 1032 | 16.5 | 44.2 | 0.52 | Example |
| | 3A | 0.016 | 0.045 | 0.061 | 98.5 | 8 | 0.0085 | 1011 | 17.5 | 46.3 | 0.89 | Example |
| K | 4A | 0.018 | 0.076 | 0.094 | 97.4 | 7 | 0.0071 | 1018 | 16.9 | 44.9 | 0.46 | Example |
| | 5A | 0.019 | 0.069 | 0.088 | 97.9 | 9 | 0.0086 | 998 | 16.8 | 44.6 | 0.48 | Example |
| | 6A | 0.008 | 0.046 | 0.054 | 98.5 | 7 | 0.0084 | 1022 | 17.1 | 51.6 | 0.91 | Example |
| L | 7A | 0.024 | 0.075 | 0.099 | 99.4 | 6 | 0.0079 | 1024 | 16.9 | 51.4 | 0.53 | Example |
| | 8A | 0.011 | 0.069 | 0.080 | 97.8 | 8 | 0.0078 | 1016 | 16.4 | 47.5 | 0.47 | Example |
| | 9A | 0.013 | 0.045 | 0.058 | 98.3 | 4 | 0.0095 | 1025 | 16.8 | 43.5 | 0.85 | Example |
| M | 10A | 0.020 | 0.064 | 0.084 | 99.6 | 5 | 0.0087 | 1033 | 17.6 | 41.9 | 0.55 | Example |
| | 11A | 0.011 | 0.081 | 0.092 | 98.7 | 3 | 0.0077 | 1046 | 17.4 | 46.7 | 0.55 | Example |
| | 12A | 0.012 | 0.051 | 0.063 | 98.5 | 4 | 0.0079 | 1037 | 17.2 | 50.8 | 0.81 | Example |
| N | 13A | 0.022 | 0.076 | 0.098 | 98.4 | 5 | 0.0085 | 1026 | 16.9 | 49.6 | 0.38 | Example |
| | 14A | 0.019 | 0.068 | 0.087 | 97.9 | 5 | 0.0077 | 1031 | 16.8 | 44.7 | 0.41 | Example |
| | 15A | 0.009 | 0.046 | 0.055 | 99.4 | 6 | 0.0076 | 1033 | 17.3 | 52.4 | 0.97 | Example |

TABLE 7-continued

| Steel sample ID | Hot rolled sheet sample No. | Composition of hot rolled steel sheet: Content of solute Ti (mass %) | Content of solute V (mass %) | Total content of solute Ti and solute V (mass %) | Microstructure of hot rolled steel sheet: Ferrite phase *1 Area ratio (%) | Ti—V based fine carbide *2: Average particle diameter (nm) | Volume ratio | Mechanical properties of hot rolled steel sheet: Tensile strength (TS) (MPa) | Total elongation (El) (%) | Hole expansion ratioλ (%) | Limit bending radius R/t | Note |
|---|---|---|---|---|---|---|---|---|---|---|---|---|
| O | 16A | 0.011 | 0.082 | 0.093 | 97.8 | 7 | 0.0082 | 1042 | 17.5 | 46.5 | 0.45 | Example |
| | 17A | 0.012 | 0.066 | 0.078 | 98.6 | 4 | 0.0083 | 1046 | 17.1 | 46.8 | 0.42 | Example |
| | 18A | 0.016 | 0.049 | 0.065 | 98.1 | 4 | 0.0079 | 1037 | 16.3 | 44.5 | 0.86 | Example |

*1: Area ratio with respect to the entire microstructure (%)

*2: Fine carbide containing Ti and V, of which "Volume ratio" represents volume ratio with respect to the entire microstructure Examples according to the present invention of Experiment 2 unanimously realized hot rolled steel sheets each having sufficiently high strength (tensile strength TS: at least 980 MPa) and excellent formability (total elongation El: at least 15%, and hole expansion ratio λ: at least 40%).

Further, Examples according to the present invention of Experiment 2 unanimously realized hot rolled steel sheets each having excellent bending properties of limit bending radius R/t≤0.7, in addition to sufficiently high strength (tensile strength TS: at least 980 MPa) and excellent formability (total elongation El: at least 15%, and hole expansion ratio λ: at least 40%), when the total content of solute V and solute Ti is equal to or higher than 0.07%.

The invention claimed is:

1. A high tensile strength hot rolled steel sheet having tensile strength of at least 980 MPa and excellent formability, comprising:

a composition including by mass %,

C: 0.07% to 0.13% (inclusive of 0.07% and 0.13%),

Si: 0.3% or less,

Mn: 0.5% to 2.0% (inclusive of 0.5% and 2.0%),

P: 0.025% or less,

S: 0.005% or less,

N: 0.0060% or less,

Al: 0.06% or less,

Ti: 0.08% to 0.14% (inclusive of 0.08% and 0. 14%),

V: 0.15% to 0.30% (inclusive of 0.15% and 0. 30%), solute V: 0.04% to 0.1% (inclusive of 0.04% and 0.1%), solute Ti: 0.05% or less, and remainder consisting of Fe and incidental impurities;

the total content, by mass %, of the solute V and the solute Ti being at least 0.07%;

microstructure with fine carbides dispersion precipitated therein, the fine carbides containing Ti and V and having the average particle diameter of less than 10 nm, as well as volume ratio with respect to the entire microstructure of at least 0.007; and matrix as ferrite phase having area ratio with respect to the entire microstructure of at least 97%, wherein contents of C, Ti, V, S and N satisfy formula (1) and formula (2):

$$Ti \geq 0.08+(N/14\times48+S/32\times48) \quad (1)$$

$$0.8 \leq (Ti/48+V/51)/(C/12) \leq 1.2 \quad (2)$$

where C, Ti, V, S, and N represent contents (mass %) of corresponding elements, respectively.

2. The high tensile strength hot rolled steel sheet having excellent formability of claim 1, wherein the composition of the hot rolled steel sheet further includes by mass % at least one element selected from Cr: 1% or less and B: 0.003% or less.

3. The high tensile strength hot rolled steel sheet having excellent formability of claim 1, wherein the composition of the hot rolled steel sheet further includes by mass % at least one element selected from Nb and Mo such that the total content thereof is equal to or lower than 0.01 mass %.

4. A method for manufacturing a high tensile strength hot rolled steel sheet having excellent formability, comprising preparing a steel material, subjecting the steel material to hot rolling including rough rolling and finish rolling, cooling after completion of the finish rolling, and coiling to obtain a hot rolled steel sheet, the method further comprising:

preparing the steel material to have a composition including by mass %,

C: 0.07% to 0.13% (inclusive of 0.07% and 0. 13%),

Si: 0.3% or less,

Mn: 0.5% to 2.0% (inclusive of 0.5% and 2.0%),

P: 0.025% or less,

S: 0.005% or less,

N: 0.0060% or less,

Al: 0.06% or less,

Ti: 0.08% to 0.14% (inclusive of 0.08% and 0. 14%),

V: 0.15% to 0.30% (inclusive of 0.15% and 0. 30%), solute V: 0.04% to 0.1% (inclusive of 0.04% and 0.1%), solute Ti: 0.05% or less, and remainder consisting of Fe and incidental impurities;

setting finish rolling completing temperature in the finish rolling to be equal to or higher than 880° C.;

setting the average cooling rate in the cooling process to be at least 20° C./s; and setting coiling temperature in the coiling to be 580° C. or higher, wherein contents of C, Ti, V, S and N satisfy formula (1) and formula (2):

$$Ti \geq 0.08+(N/14\times48+S/32\times48) \quad (1)$$

$$0.8 \leq (Ti/48+V/51)/(C/12) \leq 1.2 \quad (2)$$

wherein C, Ti, V, S, and N represent contents (mass %) of corresponding elements, respectively.

5. The method for manufacturing a high tensile strength hot rolled steel sheet of claim 4, wherein the composition of the steel material further includes by mass % at least one element selected from Cr: 1% or less and B: 0.003% or less.

6. The method for manufacturing a high tensile strength hot rolled steel sheet of claim 4, wherein the composition of the steel material further includes by mass % at least one element selected from Nb and Mo such that the total content thereof is equal to or lower than 0.01 mass %.

7. The high tensile strength hot rolled steel sheet having excellent formability of claim 1, wherein the composition of the hot rolled steel sheet further includes by mass % at least one element selected from Cr: 1% or less and B: 0.003% or less.

8. The high tensile strength hot rolled steel sheet having excellent formability of claim 1, wherein the composition of the hot rolled steel sheet further includes by mass % at least one element selected from Nb and Mo such that the total content thereof is equal to or lower than 0.01 mass %.

9. The high tensile strength hot rolled steel sheet having excellent formability of claim 2, wherein the composition of the hot rolled steel sheet further includes by mass % at least one element selected from Nb and Mo such that the total content thereof is equal to or lower than 0.01 mass %.

10. The method for manufacturing a high tensile strength hot rolled steel sheet of claim 4, wherein the composition of the steel material further includes by mass % at least one element selected from Cr: 1% or less and B: 0.003% or less.

11. The method for manufacturing a high tensile strength hot rolled steel sheet of claim 4, wherein the composition of the steel material further includes by mass % at least one element selected from Nb and Mo such that the total content thereof is equal to or lower than 0.01 mass %.

12. The method for manufacturing a high tensile strength hot rolled steel sheet of claim 5, wherein the composition of the steel material further includes by mass % at least one element selected from Nb and Mo such that the total content thereof is equal to or lower than 0.01 mass %.

13. The high tensile strength hot rolled steel sheet having excellent formability of claim 7, wherein the composition of the hot rolled steel sheet further includes by mass % at least one element selected from Nb and Mo such that the total content thereof is equal to or lower than 0.01 mass %.

14. The method for manufacturing a high tensile strength hot rolled steel sheet of claim 10, wherein the composition of the steel material further includes by mass % at least one element selected from Nb and Mo such that the total content thereof is equal to or lower than 0.01 mass %.

15. The high tensile strength hot rolled steel sheet having excellent formability of claim 1, wherein the content, by mass %, of Mn is at least 1.36% and the tensile strength of the steel sheet is at least 1016 MPa.

16. The method for manufacturing a high tensile strength hot rolled steel sheet of claim 4, wherein the content, by mass %, of Mn is at least 1.36% and the tensile strength of the steel sheet is at least 1016MPa.

* * * * *